US008458824B2

(12) United States Patent
Krämer

(10) Patent No.: US 8,458,824 B2
(45) Date of Patent: Jun. 11, 2013

(54) DEVICE FOR ATTACHING A WALL-MOUNTED OBJECT

(75) Inventor: Jörg Krämer, Merzig-Besseringen (DE)

(73) Assignee: Villeroy & Boch AG, Mettlach (DE)

( * ) Notice: Subject to any disclaimer, the term of this patent is extended or adjusted under 35 U.S.C. 154(b) by 807 days.

(21) Appl. No.: 12/593,807

(22) PCT Filed: Dec. 10, 2008

(86) PCT No.: PCT/EP2008/010471

§ 371 (c)(1),
(2), (4) Date: Sep. 29, 2009

(87) PCT Pub. No.: WO2009/074301

PCT Pub. Date: Jun. 18, 2009

(65) Prior Publication Data

US 2010/0107322 A1 May 6, 2010

(30) Foreign Application Priority Data

Dec. 12, 2007 (DE) ..... 20 2007 017 328 U

(51) Int. Cl.
*E03D 11/00* (2006.01)
*E03D 11/14* (2006.01)

(52) U.S. Cl.
USPC ..... 4/252.2

(58) Field of Classification Search
USPC ..... 4/252.1–252.6
See application file for complete search history.

(56) References Cited

U.S. PATENT DOCUMENTS 2,071,337 A 2/1937 Groeniger

FOREIGN PATENT DOCUMENTS

| | | | |
|---|---|---|---|
| DE | 100 24 186 | A1 | 11/2001 |
| EP | 0 504 587 | A | 9/1992 |
| EP | A0504587 | * | 9/1992 |
| EP | 1 338 711 | A1 | 8/2003 |
| EP | A1338711 | * | 8/2003 |
| EP | 1 367 186 | A | 12/2003 |
| EP | A1367186 | * | 12/2003 |
| EP | 1 750 021 | A | 2/2007 |
| EP | A1750021 | * | 2/2007 |
| FR | 815 333 | A | 7/1937 |
| FR | 854052 | | 4/1940 |
| FR | 2 159 966 | A | 6/1973 |
| FR | 2159966 | * | 6/1973 |
| JP | 56-001098 | B2 | 1/1981 |
| JP | 05-028297 | U | 4/1993 |
| NL | 9 401 071 | A | 2/1996 |
| NL | A9401071 | * | 2/1996 |

OTHER PUBLICATIONS

International Preliminary Examination Report of PCT/EP2008/010471, dated Jul. 15, 2010, 10 pages.

* cited by examiner

*Primary Examiner* — Lori Baker
(74) *Attorney, Agent, or Firm* — Foley & Lardner LLP

(57) ABSTRACT

The invention relates to a device for the attachment of a wall-mounted object, such as an item of sanitary ware and in particular a toilet bowl, to a wall (W) using at least one wall bracket (2) which can be fixed to the wall (W) of a building, an object, such as the body of a toilet bowl (3), being supported on said wall bracket (2) and said object (3) being screwed to said wall bracket by means of a respective locking screw (4) which engages through a respective hole (5) in the upper side (6) of the object (3) and can be screwed down into the respective wall bracket (2) from above.

8 Claims, 3 Drawing Sheets

DEVICE FOR ATTACHING A WALL-MOUNTED OBJECT

Figure 3:
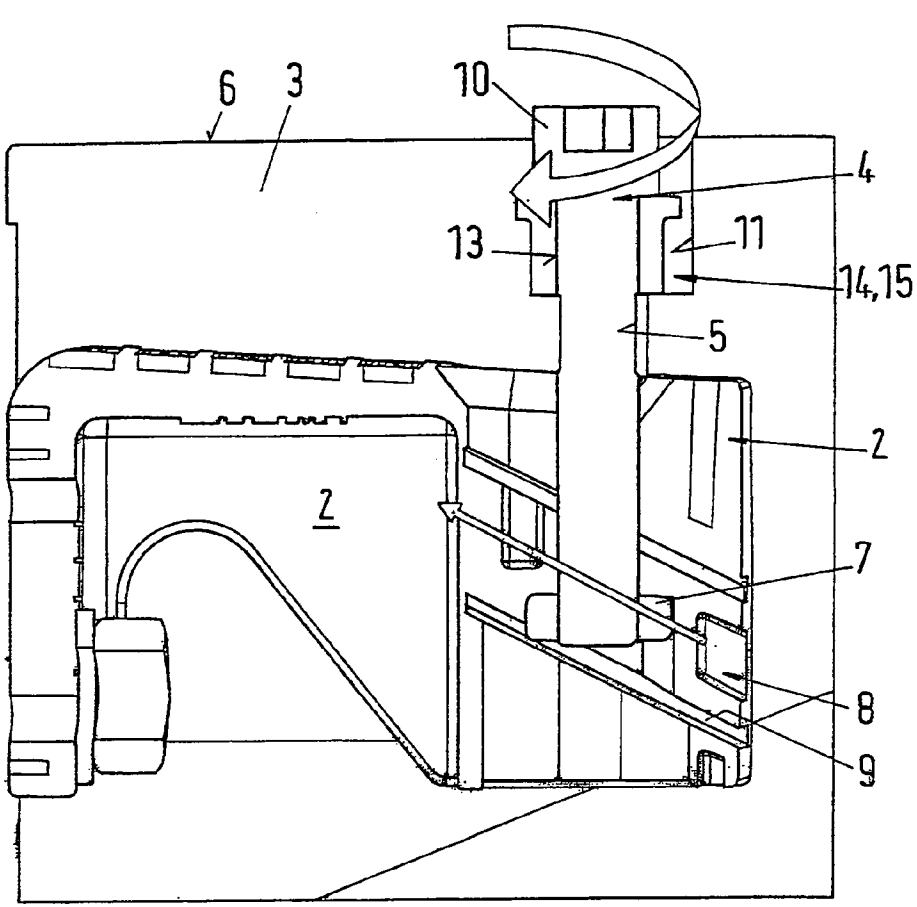

The invention relates to a device for the attachment of a wall-mounted object, such as an item of sanitary ware and in particular a toilet bowl, to a wall by means of at least one wall bracket which can be fastened to the wall, an object, such as the body of a toilet bowl, being supported on said wall bracket and screwed down into it.

EP 1 338 711 A1 discloses a countersunk fastening device for wall-mounted objects which is intended to facilitate a secure attachment of the object to the wall without having a negative aesthetic effect on the overall impression. In this respect, the fastening device is to comprise a pipe with an internally threaded portion for engagement with an appropriately threaded bolt for cantilevered attachment to a wall, and the pipe is to be inserted in a corresponding through hole in a part of the object to be mounted on the wall. Furthermore, the fastening device comprises a clamping sleeve—which can be used in such a way that it surrounds the pipe screwed onto the bolt until it butts up against the inside wall of the part of the object to be wall-mounted—and a screw element which engages in a radial through hole in the sleeve and acts via the corresponding end on an inclined surface formed by a corresponding radial recess made in the pipe, in which case, due to the presence of the inclined surface, tightening of the screw element gives rise to a pulling action on the pipe and a sliding action of the sleeve in axial direction onto the part of the object to be fixed to the wall. For this purpose, the item of sanitary ware, described by way of example as a toilet bowl, must have two through holes in a rear wall necessarily provided so as to face the wall and two holes in a sidewall, through which on the one hand the bolts for attachment to the wall can be inserted and on the other hand a tool, for example a hexagonal spanner, can be inserted for manipulating the screw element. For the fixing of a toilet seat or lid, two additional holes then have to be provided in the upper side of the body of the toilet bowl.

It is the objective of the present invention to propose a device for fixing a wall-mounted object, such as an item of sanitary ware, which, whilst having sufficient stability and load-bearing capacity, provides for simple mounting and a reduction in manufacturing costs, dispenses with the need for mounting holes at the side, and possibly at the same time, if the object involves the body of a toilet, provides for the fixing of a toilet seat.

This objective is, for example, basically achieved with a fixing device of the above-mentioned type in that a respective locking screw engages through a respective hole in the upper side of the body of the object and can be screwed down into the respective wall bracket from above. In this way, unsightly through holes at the side and additional through holes at the rear are dispensed with, with the result that, for the reduction of material consumption and weight for example, the body of the object does not need to have a rear wall. The holes provided for the locking screws—preferably two in number, one on each side of the vertical median plane towards the rear of the body of the object—can be those holes which are normally provided anyway for fixing a separate toilet seat or lid made, for example, of plastic or wood.

Moreover, the locking screw can co-operate with a locknut which is housed in a slide in such a way as to be torque-resistant, said slide, incorporated in the wall bracket for example, being mounted so as to slide on a track of the wall bracket which rises diagonally towards the wall. By screwing in the locking screw through the hole, said locking screw inevitably draws the, for example ceramic, body of the toilet bowl, by way of the slide and on account of the slope of the track, towards the wall of the building on which it is to be mounted. For this purpose, the locking screw can pass through the wall bracket in a slot having its longitudinal axis running perpendicular to the wall. The locknut can also be formed by a threaded portion of the wall bracket itself or by a threaded portion of the slide.

The top end of the locking screw, possibly provided with a screw head, can be countersunk in the hole, or in a recess incorporating the hole and possibly made wider than the hole, made in the upper side of the body of the object.

In the region of the hole or recess, the shank of the locking screw is preferably surrounded by a metal sleeve, possibly encased in plastic, so that the, for example ceramic, body of the object is relieved of pressure in the area where the screw is inserted.

In another preferred embodiment of the invention, a hinge for a toilet seat or lid can be fixed to the body of a toilet bowl by means of the locking screw, with the result that there is no need for a separate fastening device for the toilet seat or lid.

According to another concept of the invention, the hinge of a toilet seat or lid can be configured, positioned and dimensioned in such a way that the hole or possibly provided recess in the body of the toilet bowl for its attachment to the wall is covered.

In another preferred embodiment of the invention, the locking screw has, at its top end, a cage accommodating the possibly provided screw head, with a cage nut being held or formed in said cage in such a way as to be torque-resistant; a fixing screw for a hinge of a toilet seat or lid can then be screwed down into said cage nut. Owing to the use of a separate cage nut, the fixing screw of the body of the toilet bowl can be tightly screwed down, whilst the nut for receiving the means for fixing the toilet seat or lid retains the possibility of adjustment.

Further aims, features, advantages and possible applications of the invention are made apparent in the following description of working examples with reference being made to the attached drawings. Moreover all the described and/or illustrated features, separately or in any combination, constitute the subject-matter of the invention, and this irrespective of their inclusion in individual claims or when referring back to preceding claims.

Figure 1:
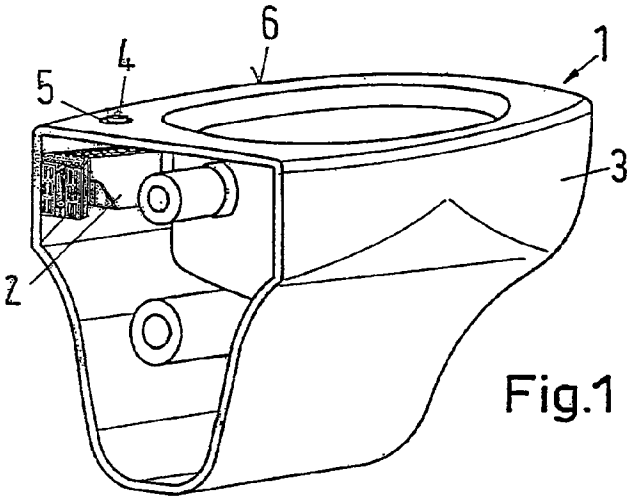
Figure 2:
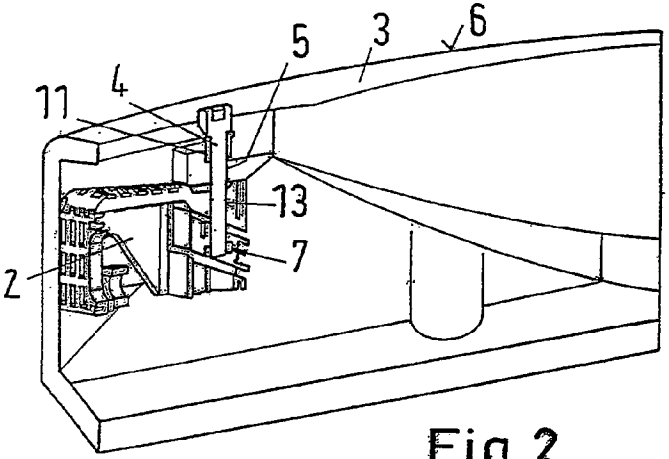
Figure 4:
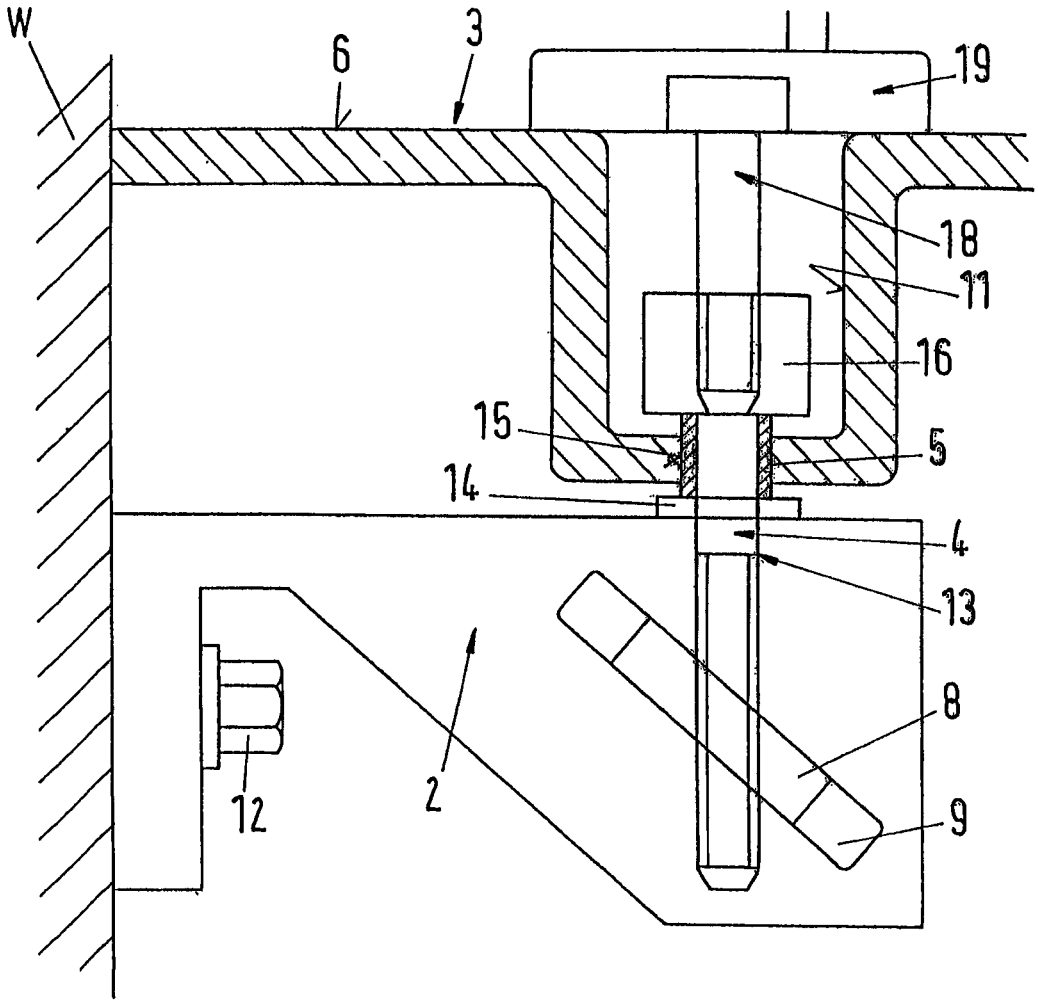
Figure 5A:
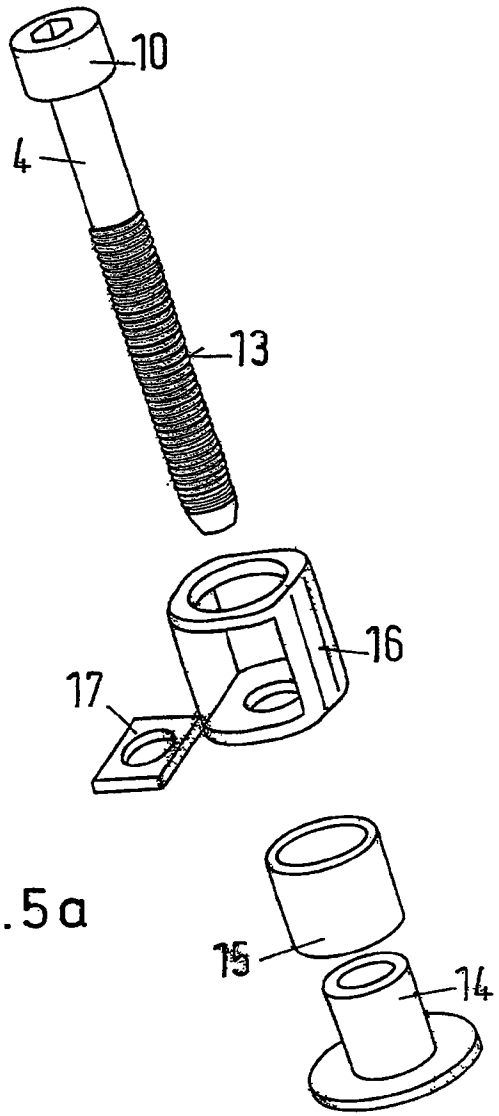
Figure 5B:
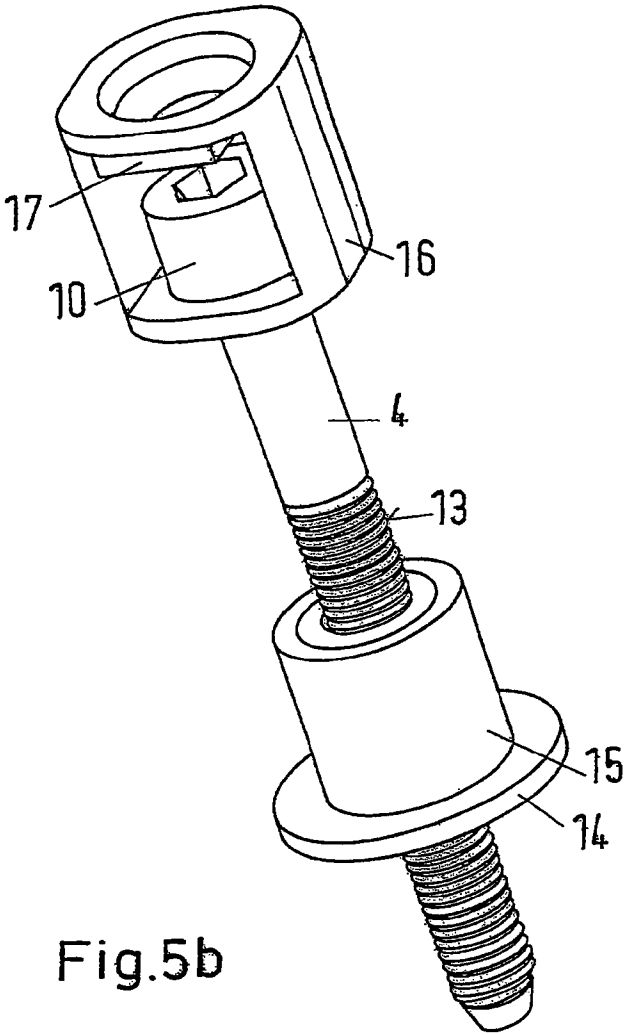

The drawings are as follows:

FIG. 1 is an oblique view from the rear of the body of an object according to the invention in the form of the body of a toilet bowl with a wall bracket for its attachment to the wall of a building (not shown), without toilet seat or lid, FIG. 2 is a representation on a larger scale when compared with FIG. 1, partly broken away, to illustrate schematically the fixing device together with the wall bracket in relation to the body of the toilet bowl, FIG. 3 is a side view of a representation of a cut-away portion, partly in section and on a larger scale when compared with FIG. 2, for illustrating the connection of a locking screw of the body of the toilet bowl to the wall bracket, FIG. 4 is a schematic vertical section of another form of the fixing device according to the invention, which at the same time serves to fix a toilet seat or lid to the body of the toilet bowl, and FIGS. 5*a* and 5*b* show the component parts, in an exploded view (FIG. 5*a*) and an assembled view (FIG. 5*b*), of the particular configuration of a locking screw for a fixing device according to FIG. 4, which can be connected to a fixing screw for a hinge of a toilet seat or lid.

FIG. 1 shows an item of sanitary ware in the form of a toilet bowl 1 to be used with the invention, with the body of an object in the form of, for example, the ceramic body 3 of a toilet bowl basically having no rear wall, thus resulting in a saving in material and weight. The body 3 of the toilet bowl is fixed to a building wall W by means of at least one wall bracket 2, which can be fastened to the building wall W using wall bolts 12, the body 3 of the toilet bowl being supported on said wall bracket 2 after it has been fitted.

The body 3 of the toilet bowl is attached to the wall bracket 2 by means of at least one locking screw 4, which engages through a round hole 5 in the upper side 6 of the toilet bowl body 3 and is screwed down into the wall bracket 2 from above. For this purpose, holes 5 can be used which are usually provided for fixing a hinge of a toilet seat or lid (not represented in the drawings). When it has been completely screwed in, the upper side of the locking screw 4 can lie flush with the upper side 6 of the body 3 of the toilet bowl or can be countersunk into this.

As can be seen in FIG. 2, the threaded portion of the locking screw 4 cooperates with a locknut 7, which is held in a slide 8 in such a way as to be torque-resistant. The slide 8 is incorporated into the wall bracket 2 and is mounted so as to slide on a track 9 which rises diagonally towards the building wall W. With tightening of the locking screw 7, the body 3 of the toilet bowl, made of ceramic for example, is thus drawn tightly against the building wall W. For this purpose, the locking screw 4 passes through the wall bracket 2 in a slot having its longitudinal axis running perpendicular to the building wall W.

In FIG. 3, it can be seen how the top end of the locking screw 4, possibly provided with a screw head 10, can be countersunk in a recess 11 which incorporates the hole 5 and is provided in the upper side 6 of the body 3 of the toilet bowl. In the illustrated case, the screw head 10 is provided with an inner hexagon socket. It can also be seen in FIG. 3 that the shank 13 of the locking screw 4 is surrounded by a metal sleeve 14 in the region of the hole 5 or recess 11, said metal sleeve 14 for its part being provided with a plastic covering 15. This ensures relief of pressure on the ceramic material of, for example, the toilet bowl 1 in the fixing region.

According to the working examples illustrated in FIGS. 1 to 3, the fixed component of a hinge for a toilet seat or lid can also be secured to the body 3 of the toilet bowl by means of the locking screw 4. Moreover, the hinge can cover the hole 5 or recess 11 so that the hole 5 and/or recess 11 are/is not visible after fitting.

FIG. 4 shows how, in another embodiment of the invention, the wall bracket 2 can be mounted on the building wall W by means of a wall bolt 12. In the fitted state, the rear edge of the upper side 6 of the body 3 of the toilet bowl rests directly against the inside surface of the building wall W. In the area towards the rear, the wall bracket 2 projects under the upper side 6 of the body 3 of the toilet bowl. There is no need for the body 3 of the toilet bowl to have a rear wall for fixing purposes. With the embodiment illustrated in FIG. 4, the screw head 10 (cp. FIGS. 5*a* and 5*b*) which is not visible in this drawing is housed in a cage 16. The hole 5 in the upper side 6 of the body 3 of the toilet bowl is at the lowest point of a recess 11 made in the upper side 6 of the body 3 of the toilet bowl. In the region of the hole 5, the shank 13 of the locking screw 4 is enclosed by the metal sleeve 14, which for its part is encased by a plastic covering 15. The cage 16 is seated on the upper side of the metal sleeve 14.

As can be seen in FIGS. 5*a* and 5*b*, a separate cage nut 17, which is rectangular in the illustrated case, is located in the cage 16 so as to be torque-resistant but axially displaceable relative to the cage 16. The cage nut 17 can, for example, be pushed in through a side opening in the cage 16. An additional fixing screw 18 can be screwed into the cage nut 17 from above, said additional fixing screw 18 serving to hold the fixed component of a hinge 19 of a toilet seat or lid made for example of wood or plastic (not shown). The hinge 19 is constructed, positioned and dimensioned in such a way that the recess 11 is covered from above and thus the means of fixing the body 3 of the toilet bowl to the wall is not visible from the outside. The installation as a whole is extremely simple and reliable.

LIST OF REFERENCE NUMERALS

| | |
|---|---|
| 1 | Item of sanitary ware, toilet bowl |
| 2 | Wall bracket |
| 3 | Body of the object, body of the toilet bowl |
| 4 | Locking screw |
| 5 | Hole |
| 6 | Upper side |
| 7 | Locknut |
| 8 | Slide |
| 9 | Track |
| 10 | Screw head |
| 11 | Recess |
| 12 | Wall bolt |
| 13 | Shank |
| 14 | Metal sleeve |
| 15 | Plastic covering |
| 16 | Cage |
| 17 | Cage nut |
| 18 | Fixing screw |
| 19 | Hinge |
| W | Building wall |

The invention claimed is:

1. A device for fixing a wall-mounted object to a wall of a building comprising:

at least one wall bracket configured to attach to the wall of the building, a body of an object supported on the at least one wall bracket, the object being attached to the at least one wall bracket by a locking screw, wherein the locking screw engages through a hole in an upper side of the body of the object and is configured to screw down into the at least one wall bracket from above, wherein the locking screw has at its top end a cage configured to house a screw head and has a cage nut seated inside the cage and formed to be torque-resistant, wherein a fixing screw for a hinge of a toilet seat or lid cooperates with the cage nut.

2. A device according to claim 1, wherein the locking screw cooperates with a locknut seated in a slide and configured to be torque-resistant, wherein the slide is mounted to slide on a track of the at least one wall bracket which rises diagonally towards the wall, and wherein the locking screw passes through the at least one wall bracket in a slot.

3. A device according to claim 1, wherein the top end of the locking screw provided with the screw head, is countersunk in the hole or in a recess incorporating the hole made in the upper side of the body of the object.

4. A device according to claim 3, wherein a shank of the locking screw is surrounded in a region of the hole or the recess by a metal sleeve.

5. A device according to claim 1, wherein the hinge for the toilet seat or lid is fixed by the locking screw to the body of a toilet bowl.

6. A device according to claim 1, wherein the hinge of the toilet seat or lid covers the hole or a recess.

7. A device according to claim 1, wherein the wall-mounted object is a toilet bowl.

8. A device according to claim 4, wherein the metal sleeve is plastic-coated.

* * * * *